United States Patent [19]

Potticary

[11] Patent Number: 5,050,920

[45] Date of Patent: Sep. 24, 1991

[54] WASTE PICK-UP DEVICE

[76] Inventor: Richard D. Potticary, 203 Lakeridge Village, Ste. 212, Dallas, Tex. 75238

[21] Appl. No.: 492,777

[22] Filed: Mar. 12, 1990

[51] Int. Cl.[5] ..... B65B 67/12; B65D 33/06

[52] U.S. Cl. ..... 294/55; 15/257.1; 248/100; 294/1.1

[58] Field of Search ..... 294/1.1, 1.3–1.5, 294/55; 15/104.8, 257.1, 257.4, 257.7, 257.9; 56/400.11; 141/108, 109, 390, 391; 248/95, 99–101; 383/33, 34

[56] References Cited

U.S. PATENT DOCUMENTS

| | | | |
|---|---|---|---|
| D. 263,512 | 3/1982 | Kawada | 294/1.4 X |
| D. 299,075 | 12/1988 | Scott | 294/55 X |
| 1,266,522 | 5/1918 | Oldham | 294/55 X |
| 1,717,717 | 6/1929 | Marsh | 248/100 |
| 3,688,483 | 9/1972 | Hamilton | 294/55 X |
| 3,711,141 | 1/1973 | Soergel | 294/55 |
| 3,733,099 | 5/1973 | Szita | 294/55 |
| 3,754,785 | 8/1973 | Anderson | 294/55 |
| 4,012,067 | 3/1977 | Travis | 294/1.4 |
| 4,048,691 | 9/1977 | Spangler | 294/55 X |
| 4,121,866 | 10/1978 | Schall et al. | 294/1.4 |
| 4,279,437 | 7/1981 | Goldberg | 294/1.4 |
| 4,349,224 | 9/1982 | Shiozaki | 294/1.4 |
| 4,457,549 | 7/1984 | Lowery | 294/1.4 X |
| 4,783,090 | 11/1988 | Moulton | 294/1.1 X |

FOREIGN PATENT DOCUMENTS

| | | | |
|---|---|---|---|
| 1289567 | 9/1972 | United Kingdom | 294/1.1 |

*Primary Examiner*—Johnny D. Cherry

*Attorney, Agent, or Firm*—Mark A. Oathout; John R. Kirk, Jr.

[57] ABSTRACT

The present invention includes a rim which is secured to a handle. The lower edge of the rim includes a lip which assists in the pick-up of waste. A bag for catching the waste is suspended from the rim. The bag is retained on the rim by hooking the bag around hooked tabs located along the sides and lower edge of the rim and around one tab selected from several tabs which are located proximate the ends of the rim and which are arranged at incrementally further distances from the rim.

5 Claims, 1 Drawing Sheet

WASTE PICK-UP DEVICE

FIELD OF THE INVENTION

The present invention generally relates to a device for picking up waste and, more particularly, is concerned with a device having a handle attached to a rim from which a common trash bag can be suspended.

DESCRIPTION OF THE PRIOR ART

The job of picking up trash, litter and other waste both outside and inside is a cumbersome task. Much of the work is done by hand and requires that the worker lean over and pick up trash which results in worker fatigue and severely limits the amount of waste that can be picked up when the worker bends over. A butler pan was one device that was designed to overcome some of the problems associated with picking up waste by hand. However, a butler pan often requires that the worker bend over, limits the amount of waste that can be picked up and normally can only be used to pick-up small pieces of waste. A need therefore developed for a device to pick-up waste which could be used by a worker without requiring him to bend over, which was lightweight, which could be used to pick-up both small and large pieces of waste, which was easy to use and which could store large amounts of waste.

Several devices have been designed to meet this need. The devices shown in U.S. Pat. No. 3,688,483 to Hamilton, U.S. Pat. No. 3,754,785 to Anderson, U.S. Pat. No. 4,012,067 to Travis, U.S. Pat. No. 4,279,437 to Goldbarg, U.S. Pat. No. D. 263,512 to Kawada and U.S. Pat. No. D. 299,075 to Scott are illustrative of these devices.

These prior devices suffer from several disadvantages, one being that they are expensive to produce in the amount of material needed and in the design of the device. Several of the devices fail to recognize the importance of including a straight and inclined lip to be attached to the lower edge of the device so that waste can be scooped up when the device is used in conjunction with a broom.

One of the biggest problems associated with these devices is the mode of attachment which is used for attaching the trash bag to the device. The devices try to solve this problem through the use of one or more clamps. However, the bag can be more easily and economically attached and more easily removed simply by hooking the bag at various locations around the mouth of the bag. The prior devices also have problems associated with making the attachment of the bag to the device adjustable so that the tension at the mouth of the bag can be either increased or decreased to obtain a tight and secure connection at the mouth of the bag while preventing tearing of the bag. The devices also fail to recognize that many trash bags on the market today are made with drawstrings which can be utilized to help retain the bag on the device given a proper attachment structure on the device.

A need therefore exists for a waste pick-up device which includes a straight and inclined lip to assist in the picking up of trash, which allows for adjustment in the amount of tension to be placed on the mouth of the bag when the bag is attached to the device, which allows for attachment of the bag without expensive and cumbersome clamps and without moving parts, and which is lightweight, inexpensive and easy to use.

SUMMARY OF THE INVENTION

The present invention relates to a waste pick-up device designed to satisfy the aforementioned needs.

Accordingly, the present invention includes a rim which is secured to a handle. The lower edge of the rim includes a lip which assists in the pick-up of waste. A bag for catching the waste is suspended from the rim. The bag is retained on the rim by hooking the bag around tabs located along the sides and lower edge of the rim and around one tab selected from several tabs which are located proximate the ends of the rim and which are arranged at incrementally further distances from the rim. Proper retention and suspension of the bag on the rim requires that a proper amount of tension be placed on the mouth of the bag. The tension can be adjusted by selecting one of the tabs located or arranged at different incremental distances from the rim.

DETAILED DESCRIPTION OF THE INVENTION

Figure 1:
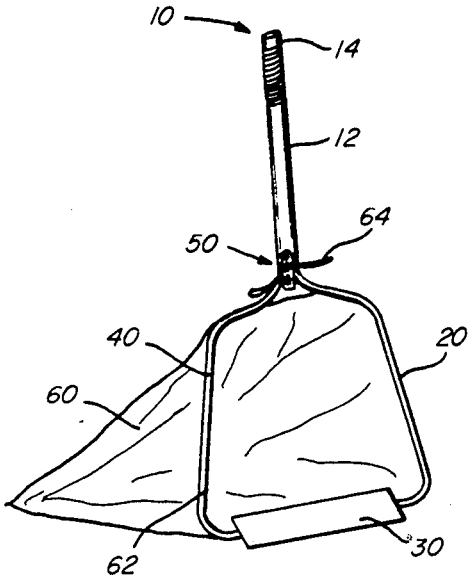
FIG. 1 is a perspective view of the waste pick-up device.

Referring now to the drawings, and more particularly to FIG. 1, there is shown the waste pick-up device 10. The waste pick-up device 10 generally includes a handle 12, a rim 20, a lip 30, a hooking means 40, and an adjustable hooking means 50. A bag 60 is retained by the waste pick-up device 10 when the pick-up device 10 is in use.

Figure 2:
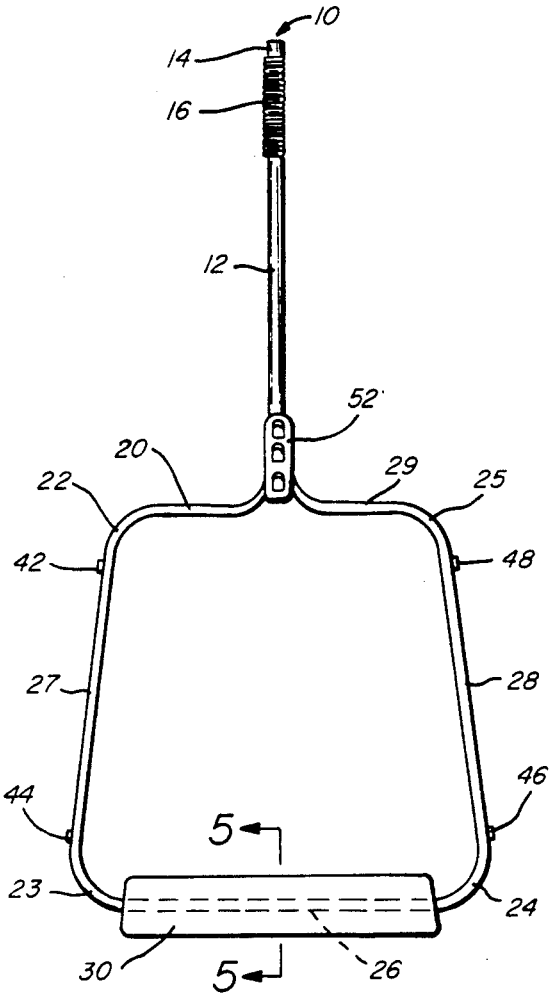
FIG. 2 is a front elevational view of the waste pick-up device.

Referring now to FIG. 2, the waste pick-up device 10 is shown in greater detail. Handle 12 is preferably tubular and may be constructed with various cross-sectional configurations such as round, square, etc. A grip 14 is placed or fitted over one end of the handle 12 and preferably includes a corrugated surface 16 to aid or assist in the grasping of the handle 12. If a grip 14 is not placed over the handle 12, the corrugated surface 16 could be manufactured as part of the handle 12. The grip 14 is preferably manufactured from a pliable material such as rubber, foam rubber or plastic.

A rim 20 is attached to the other end of the handle 12. The rim 20 is generally rectangular and includes arcuate corners 22, 23, 24 and 25, a straight lower edge 26, straight sides 27 and 28 and an upper side 29. The arcuate corners 22, 23, 24 and 25 are important for providing a smooth transition between the sides 27 and 28 and the upper and lower edges 29 and 26, respectively, for ease of fitting and sealing the mouth 62 of the bag 60, which is generally of a round or oval configuration, around the rim 20. The lower edge 26 should be straight since the pick-up device 10 will generally be used to pick-up waste scattered on flat surfaces. The shape or configuration of the rim 20 may be altered but it is preferable that the straight lower edge 26 be retained as well as the smooth transition corners 22, 23, 24 and 25 for retention without puncturing of the mouth 62 of the bag 60.

Figure 3:
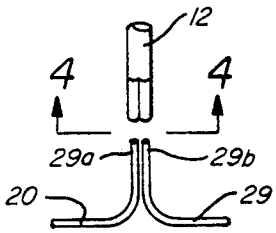
FIG. 3 is a break away view of the region where the rim is secured to the handle.
Figure 4:
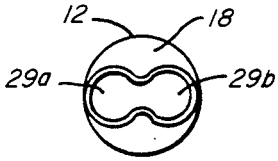
FIG. 4 is a cross-sectional view taken along line 4—4 of FIG. 3.

Referring now to FIG. 3, the upper edge 29 of rim 20 acts as a section of the rim 20 while providing a transition area for the ends 29*a* and 29*b* of the rim to merge and to be secured within the handle 12. Referring now to FIG. 4, the ends 29*a* and 29*b* of the rim 20 are preferably secured within the handle 12 by a resistance weld utilizing a typical welding material 18.

Figure 5:
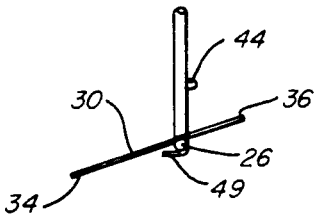
FIG. 5 is a cross-sectional view taken along line 5—5 of FIG. 2.

Referring back to FIG. 2, a lip 30 is attached to the lower edge 26 of the rim 20. As shown in FIG. 5, the lip 30 is constructed from a thin, flat plate, much like the leading edge of a dust pan. The lip 30 is preferably 0.034 inches thick. The lip 30 is attached to the lower edge 26 of rim 20 at an inclined plane. The attachment is preferably made by welding although other suitable means of attachment may be used such as riveting. The lip 30 is preferably inclined at a plane of 72° from the vertical with the vertical being defined as the axis running in the axial direction through the tubular handle 12. The leading edge 34 of the lip 30 is preferably located at a level below the level of the lower edge 26 of rim 20 so that only the leading edge 34 of lip 30 will touch the ground when the pick-up device 10 is held in a vertical position or so that the pick-up device 10 can be tilted back while still maintaining contact between the lip 30 and the ground. The trailing edge 36 of lip 30 preferably projects beyond rim 20 into the mouth 62 of the bag 60 such that waste will not fall into the bag 60 until it has been picked-up or lifted by lip 30 a short distance beyond the mouth 62.

Figure 6:
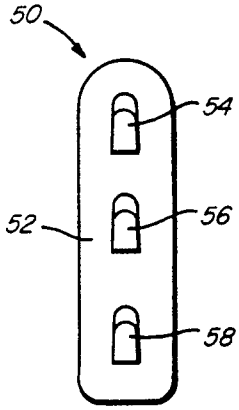
FIG. 6 is a blown-up view of the mounting plate.
Figure 7:
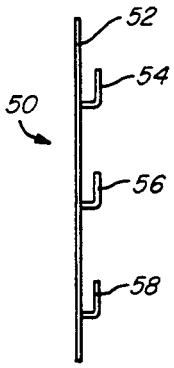
FIG. 7 is a side view of the mounting plate shown in FIG. 6.

Hooking means 40 as shown in FIG. 2 and FIG. 5 includes a first set of hooked tabs 42, 44, 46, 48 and 49 oriented around the perimeter of rim 20. Tabs 42 and 44 are located on side 27 of rim 20. Tabs 46 and 48 are located on side 28 of rim 20. Tab 49 is located on lower edge 26 of the rim 20. Tabs 42, 44, 46 and 48 are preferably located proximate the arcuate corners 22, 23, 24 and 25, respectively, to provide sufficient points of attachment around the rim 20 for retaining substantially the entire circumference of the mouth 62 of bag 60 around rim 20. The number of tabs attached to rim 20 can be increased or decreased as needed. Tabs 42, 44, 46, 48 and 49 are preferably curved at one end with a radius of curvature which matches rim 20 to increase the surface area of contact between the tabs 42, 44, 46, 48 and 49 and rim 20 when rim 20 has a round cross-sectional configuration. However, tabs 42, 44, 46, 48 and 49 could also be flat. The radius of curvature may approach a right angle if the cross-sectional configuration of rim 20 is square. The preferable structure of the first set of hooked tabs 42, 44, 46, 48 and 49 is similar to the structure of the second set of hooked tabs 54, 56 and 58 which are shown in FIGS. 6 and 7 with a radius of curvature which is substantially a right angle. The first set of hooked tabs 42, 44, 46, 48 and 49 and the second set of hooked tabs 54, 56 and 58 are preferably blunt on the protruding end around which the bag will be wrapped to prevent puncturing of the bag 60. The first set of hooked tabs 42, 44, 46, 48 and 49 are riveted or welded or attached by other suitable means to rim 20. As shown in FIG. 5, tabs 42, 44, 46, 48 and 49 project outwardly or rearwardly so that the mouth 62 of the bag can be hooked around the tabs 42, 44, 46, 48 and 49.

Referring to FIG. 6, adjustable hooking means 50 includes a second set of hooked tabs 54, 56 and 58 which are located on plate 52. The second set of hooked tabs 54, 56 and 58 are preferably punched and bent out of plate 52 although they could be welded or attached by other suitable means to plate 52. Plate 52 is preferably riveted or welded to handle 12 and/or rim ends 29*a* and 29*b* although other suitable means of attachment could be used. Tabs 54, 56 and 58 could also be attached directly to rim ends 29*a* and 29*b* or handle 12 eliminating plate 52, and the number of tabs could also be greater or less than the three tabs 54, 56 and 58 shown. The second set of hooked tabs 54, 56 and 58 are used for hooking the mouth 62 of bag 60 for retention and suspension of bag 60 on rim 20.

When bag 60 is to be suspended from rim 20, the mouth 62 will be hooked to tabs 42, 44, 46, 48 and 49 and usually only to one of the second set of tabs 54, 56 and 58. The user can select the proper tab in the second set of tabs 54, 56 and 58 to which the mouth 62 should be hooked in order to pick-up the slack in the mouth 62 of bag 60 around rim 20. To make this selection, the user must determine the proper amount of tension to be placed around the mouth 62 of the bag 60 for proper retention and suspension of bag 60 from rim 20. Once this determination is made, the user of the waste pick-up device 10 can adjust or set the tension of the mouth 62 of bag 60 around rim 20 through the selection of the tab located at a desirable distance from rim 20. Tab 58 is closest to rim 20 and therefore will produce the least amount of tension on mouth 62. Likewise, tab 54 is furthest from rim 20 and therefore will result in the largest amount of tension placed upon mouth 62. The distance from tip to tip between tab 54 and tab 56 and the distance from tip to tip between tab 56 and tab 58 is preferably 0.95 inches.

The mouths 62 of some bags 60 may include a drawstring 64 as shown in FIG. 1. Drawstring 64 will enhance the retention capabilities of mouth 62 when hooked to each of the tabs. The tension at the mouth 62 of bag 60 can also be adjusted by wrapping drawstring 64 around one tab of the second set of tabs or by wrapping the mouth itself around one of the second set of tabs.

The bag 60 may be constructed from a heavy duty nylon material or may be any common disposable trash bag. When the heavy duty nylon bag 60 is used, the bag 60 preferably stays on the rim 20 for reuse and trash is dumped out of the bag 60 into a receptacle. When a disposable trash bag 60 is used, the bags 60 may be removed from rim 20 when full and left for a vehicle to pick-up while the user of the invention continues working. Still, sacks sold under the trademark "HEFTY" are preferable as disposable bags since they include a drawstring 64 and the mouth 62 is made with a proper diameter and circumference for use with the device 10. Other bags with drawstrings are preferred to bags without drawstrings.

The device 10 can be used either in conjunction with any common broom or can be used in conjunction with a rake to gather leaves or litter. The device 10 is preferably made from cadmium plated steel although other metallic and non-metallic materials may be used. It is preferable that all tabs be made of a rigid material although a pliable material could be used as well. A particular advantage is obtained when using the device of this invention to "harvest" aluminum cans for recycling since the cans can easily be swept, or kicked, into the bag and the bag can be closed by tightening the drawstring when full.

The preferred embodiment of this invention has been shown and described above. It is to be understood that minor changes in the details, construction and arrangement of the parts may be made without departing from the spirit or scope of the invention as claimed.

What is claimed is:

1. A waste pick-up device for use in combination with a disposable bag having a drawstring at a mouth of the bag, comprising:

a handle;

a rim having a lower edge, two sides and two ends which are secured to one end of said handle;

a thin planar plate attached on top of the lower edge of said rim having a leading edge at an inclined angle to serve as a lip for the pick-up of waste and having a trailing edge which extends beyond said rim into the mouth of the disposable bag;

a first plurality of blunt substantially rectangular shaped tabs attached to the sides and below the lower edge of said rim for retaining the mouth of the disposable bag by the drawstring on said rim;

said tabs attached to the sides being rearwardly directed and said tab below the lower edge being forwardly directed; and a second plurality of blunt tabs, upwardly directed, linearly arranged and rigidly attached relative to said handle and said rim proximate a point where said rim is secured to said handle where each successive tab is located at an incrementally further distance from said rim such that the tension at the mouth of the bag retained around said rim is adjustable through the selection of one tab from said second plurality of tabs for the retaining of the drawstring.

2. A waste pick-up device for use in combination with a disposable bag having a drawstring at a mouth of the bag, comprising:

a handle;

a rim having a lower edge, two sides and two ends which are secured to one end of said handle;

a thin planar plate attached on top of the lower edge of said rim having a leading edge at an inclined angle to serve as a lip for the pick-up of waste and having a trailing edge which extends beyond said rim into the mouth of the disposable bag;

a first plurality of tabs attached to the sides and below the lower edge of said rim for retaining the mouth of the disposable bag by the drawstring on said rim; and a second plurality of tabs upwardly directed, linearly arranged and rigidly attached relative to said handle and said rim proximate a point where said rim is secured to said handle where each successive tab is located at an incrementally further distance from said rim such that the tension at the mouth of the bag retained around said rim is adjustable through the selection of one tab from said second plurality of tabs for the retaining of the drawstring.

3. The waste pick-up device for use in combination with a disposable bag having a drawstring at the mouth of the bag according to claim 2, wherein said first and said second plurality of tabs are blunt on an end around which the bag is retained.

4. The waste pick-up device for use in combination with a disposable bag having a drawstring at the mouth of the bag according to claim 2, wherein said first plurality of tabs are substantially rectangular shaped.

5. The waste pick-up device for use in combination with a disposable bag having a drawstring at the mouth of the bag according to claim 2, wherein said tabs attached to the sides are rearwardly directed and said tab below the lower edge is forwardly directed.

* * * * *